United States Patent [19]

Sampson

[11] 4,036,009

[45] July 19, 1977

[54] HOROLOGICAL INSTRUMENT

[76] Inventor: Mark J. Sampson, 1390 Piedmont Road, Atlanta, Ga. 30309

[21] Appl. No.: 582,173

[22] Filed: May 30, 1975

[51] Int. Cl.[2] ..... G04B 19/06

[52] U.S. Cl. ..... 58/127 R; 58/50 R

[58] Field of Search ..... 58/1 R, 2 R, 50 R, 3, 58/5, 88, 127 R; 33/270

[56] References Cited

U.S. PATENT DOCUMENTS

| | | | |
|---|---|---|---|
| 2,584,087 | 1/1952 | Barbieri | 58/3 |
| 3,430,433 | 3/1969 | Sandor | 58/50 R |
| 3,439,492 | 4/1969 | Gravenson | 58/1 R |
| 3,829,980 | 8/1974 | Iversen | 33/270 |
| 3,832,842 | 9/1974 | Parker | 58/50 R |

*Primary Examiner*—Robert K. Schaefer
*Assistant Examiner*—Jit W. Miska
*Attorney, Agent, or Firm*—Newton, Hopkins & Ormsby

[57] ABSTRACT

A horological instrument is disclosed comprising a dial, an electrically energizable light source, gnomon means for casting a shadow on the dial, and means for imparting relative movement between the electrically energizable light source and the dial to move the shadow on the dial in indicating time.

4 Claims, 4 Drawing Figures

HOROLOGICAL INSTRUMENT

BACKGROUND OF THE INVENTION

Throughout recorded history man has used horological instruments for indicating time. These devices have evolved from the most crude forms of sundials to the ultra-precise chronometers used today in navigation and astronomy. The sundial type horological instruments have one pronounced attribute ancillary to its time indicating capability, namely its ability to portray a relation between the passage of time and the relative movement of our planet earth with respect to the sun. This facet is of continuing importance to adults since the passage of time is psychologically so closely associated with the various periods of the day. For children, the sundial offers a unique educational instrument useful in the learning of both time recognition as well as in its association with the movement of heavenly bodies and the various periods of the day.

Notwithstanding the just-mentioned attributes of sundial type horological instruments, they exhibit several obvious disadvantages. Firstly, the use of sundials is limited to those daylight hours when the sun is locally positioned to cast a shadow on the instrument and even then only to those portions of such periods in which the local weather conditions permit the sun to cast a discernible shadow on the dial. In addition, sundials must be located out-of-doors or in such specialty types of enclosures which permit the rays of the sun to strike the dial during most of the day. Furthermore, popular sundials are quite inaccurate due to their seasonal variations, their longitudinal and latitudinal placement within governmentally established time zones, and legislatively enacted changes in local time such as between standard and daylight saving time.

Most modern day timepieces, of course, are not of sundial construction at all but rather employ two or more hands coupled with motor means for continuous movement over a dial. These timepieces have a relatively high degree of accuracy as well as other attributes such as compactness, readibility, portability and longevity. Notwithstanding these attributes most timepieces in modern use exhibit no relation to the various periods of daylight hours or any association with planetary movement. This leads to a dehumanizing effect upon adults and to difficulty in training children in time recognition and its relation with the heavens. Should a horological instrument be devised that possessed the attributes of both sundials and timepieces, a very decided advance in the art would be achieved.

Accordingly, it is the general object of the present invention to provide an improved horological instrument.

More specifically, it is an object of the invention to provide a horological instrument which is capable of indicating time with both accuracy and a symbolic association with relative movement of our planet with respect to the sun.

Another object of the invention is to provide a horological instrument which may be readily used in educating children in the principles of time recognition and its heavenly body basis.

Yet another object of the invention is to provide a horological instrument of the the type described which is attractive in appearance and duable and requires little or no periodic adjustment.

In one form of the invention a horological instrument is provided comprising a dial, an electrically energizable light source, gnomon means for casting a shadow on the dial, and means for imparting relative movement between the electrically energizable light source and the dial to move the shadow on the dial in indicating time.

In another form of the invention a horological instrument is provided comprising a dial, a gnomon mounted above the dial, means for directing a beam of light along a beam path onto the gnomon and dial, and means for moving the beam path about the gnonom to cast a shadow on the dial indicative of time.

DETAILED DESCRIPTION OF THE DRAWING

Figure 1:
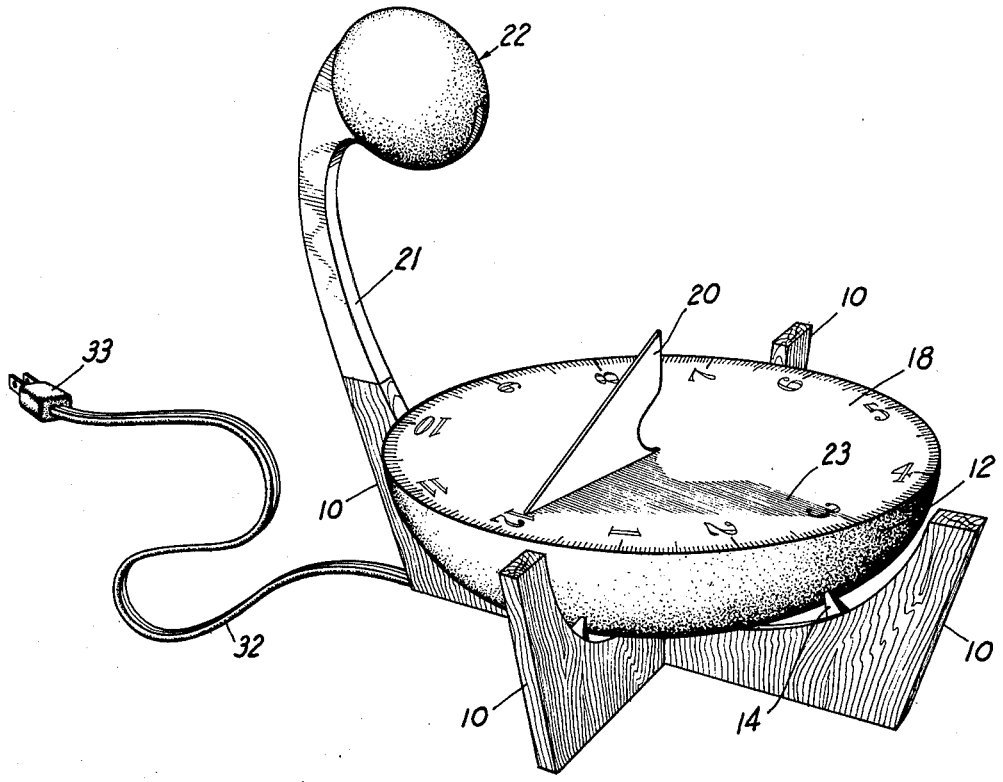
FIG. 1 is a perspective view of a horological instrument embodying principles of the invention in one preferred form.
Figure 2:
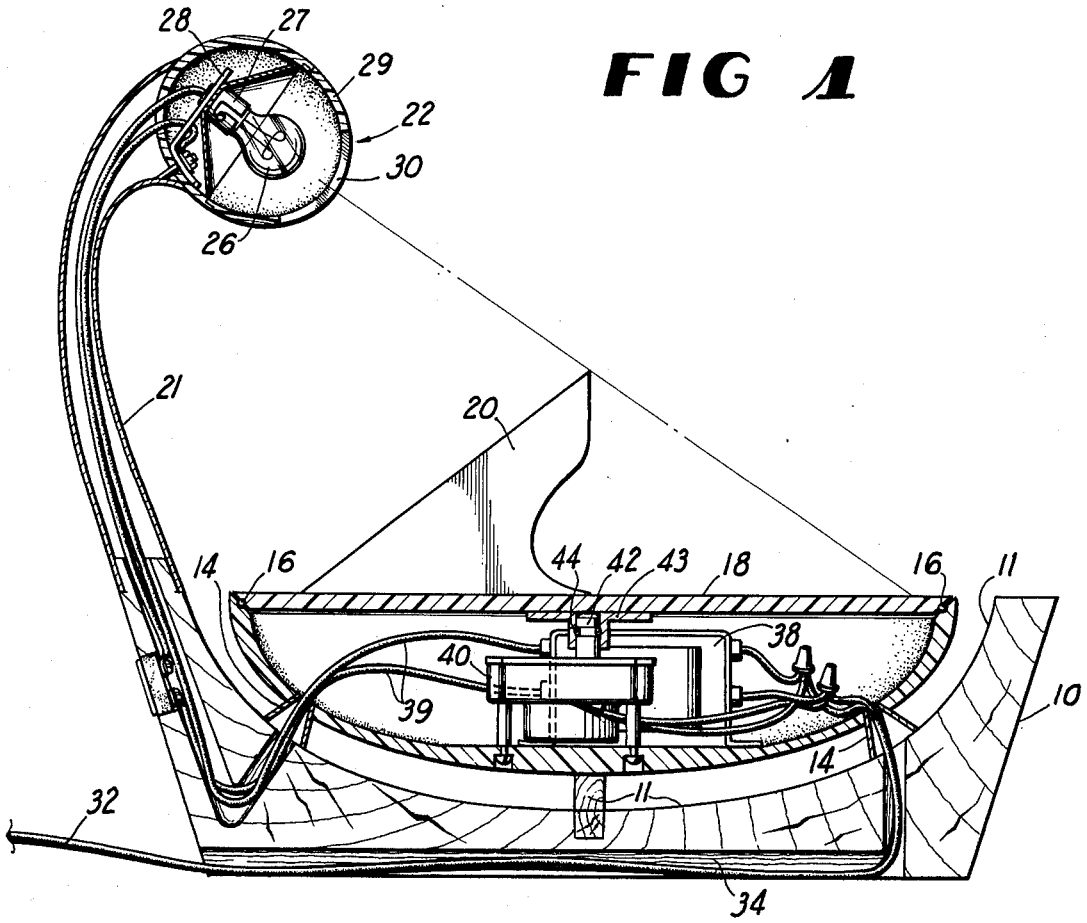
FIG. 2 is a side view in cross section of the horological instrument illustrated in FIG. 1.

Referring now in more detail to the drawing, there is shown in FIGS. 1 and 2, a horological instrument comprising a wooden stand having two pairs of crossed legs 10 with inwardly facing, concave surfaces 11 above which a cup-shaped, base 12 is nestled in spaced relation with the stand legs by means of a set of truncated conical supports 14. The rim of base 12 is inwardly beveled and provided with a set of semi-spherical indentations in which are rotatably housed a race of ball bearings 16. A circular dial 18 having time indicating indicia printed thereon adjacent the periphery of the dial is movably supported atop base 12 upon the ball bearings. A gnomon 20 is mounted on the dial. A high intensity lamp is mounted on a stanchion 21 extending upwardly from a stand leg for casting a beam of light onto dial 18 and gnomon 20 to produce a shadow 23 having a point or apex indicating time. In FIG. 1 the instrument is shown indicating approximately three o'clock.

With continued reference to FIGS. 1 and 2, lamp 22 is seen in more detail to include an electrically energizable light source in the form of an incandescent bulb 26 mounted within a bayonet type socket 27 secured by a bracket 28 to an interior wall of lamp housing 29 with the bulb positioned adjacent a slot 30 within the lamp housing. An electrical chord 32, having a plug 33 on an end thereof distal the instrument, passes into the interior of base 12 beneath dial 18 through a passage 34 located adjacent the bottom of one pair of stand legs 10 and through one of the conical supports 14. Within base 12 chord 32 is connected to the primary windings of a step down transformer 38 and to an electric clock motor 40. Bulb 26 is coupled across the transformer secondary windings by wires 39 through light switch 41. The output shaft 42 of clock motor 40 is coupled to the bottom of dial 18 through bracket 43 via O ring 44 for rotating the dial upon the base 12.

Figure 3:
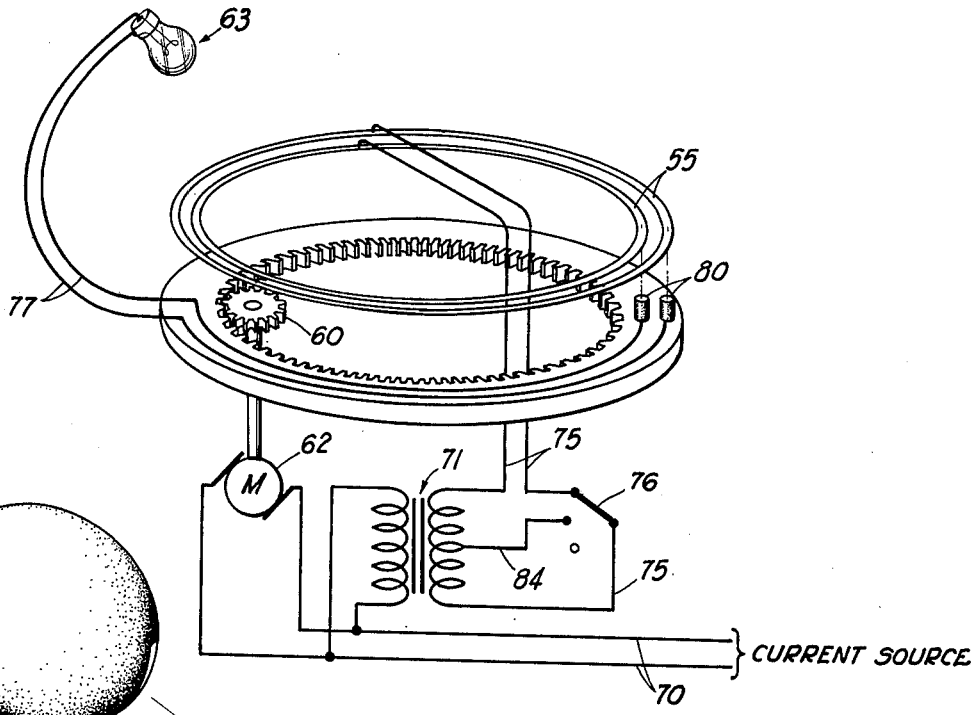
FIG. 3 is a schematic illustration of a horological instrument embodying principles of the invention in another perferred form.
Figure 4:
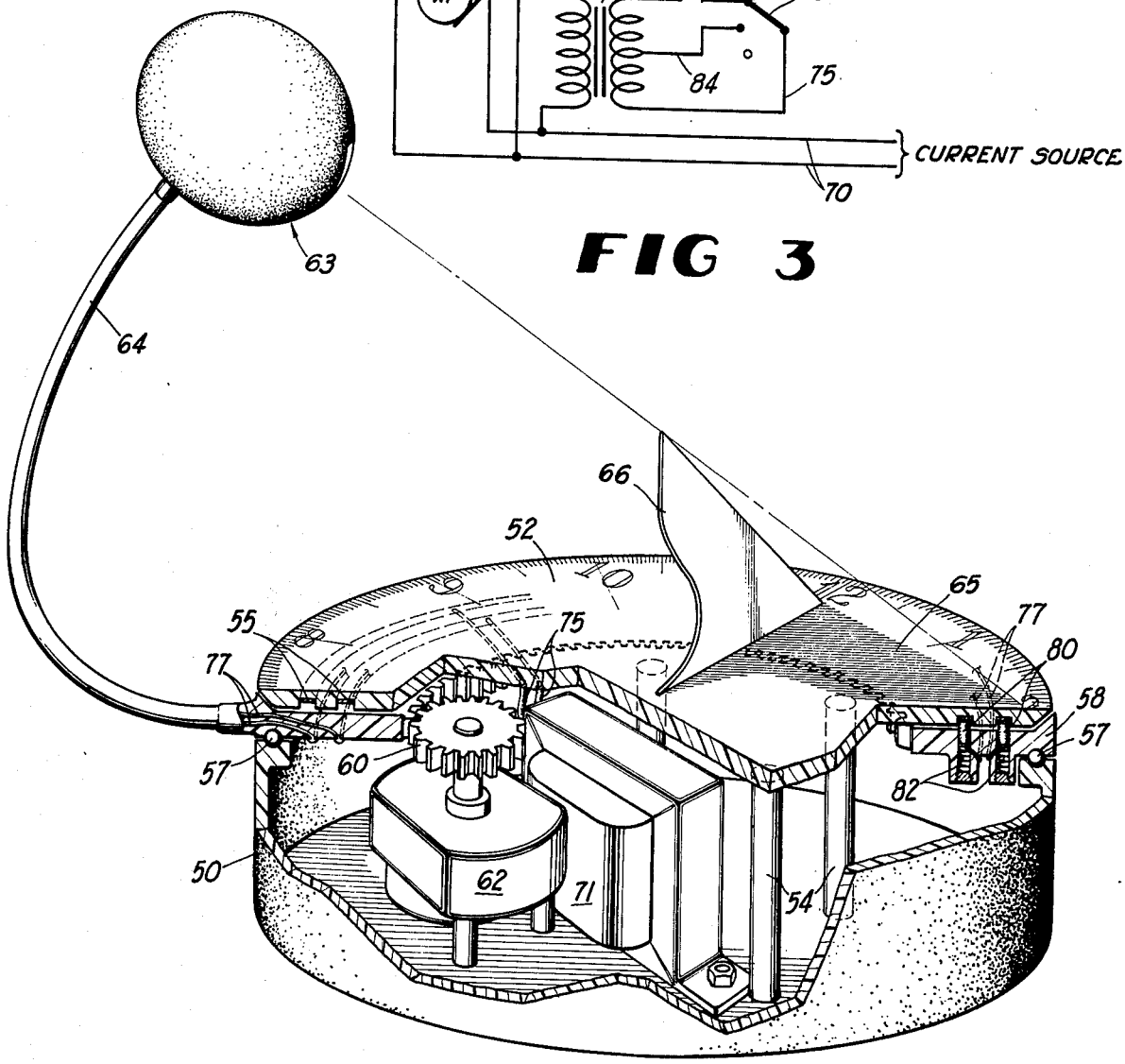
FIG. 4 is a perspective view of the horological instrument schematically illustrated in FIG. 3 shown partially cut away to reveal internal components thereof.

Referring next to FIGS. 3 and 4, an alternative embodiment is shown comprising a cylindrical housing 50 and a disc-shaped dial 52 rigidly supported atop housing 50 by means of a set of columns 54. The inwardly facing, bottom surface of dial 52 is provided with two concentric, circular channels in which are fixed two metallic electricly conductive contact rings 55. An upper surface of cylindrical housing 50 facing a peripheral portion of dial 52 is provided with a bearing race in which are rotatably disposed a set of ball bearings 57. An internal ring gear 58 having an annular bearing race formed in a lower peripheral surface thereof is movably disposed between the upper surface of housing 50 and the lower surface of dial 52 with the internal gear teeth in mesh with a pinion 60 mounted to an output shaft 61 of an electric motor 62 mounted to the bottom of housing 50. A high intensity lamp 63 is mounted to the periphery of internal gear 58 by means of a hollow arcuate stem 64. which disposes the lamp angularly above the dial 52 to cast a shadow 65 from the gnomon 66 upon the dial, the apex of the shadow 65 in concert with the indicia being indicative of time.

The horological instrument of FIGS. 3 and 4 is powered by electric energy received from a source of electric current through lines 70 which are connected to electric motor 62 and to the primary windings of a transformer 71 housed aside motor 62 within housing 50. The secondary windings of the transformer are connected by wires 75 through a switch 76 and wires 75 are then partially embedded in dial 52 to contact rings 55 also embedded in the dial. Lamp 63 is connected to the contact rings 55 by wires 77 which extend down through arcuate stem 64 to a pair of brushes 80 slidably mounted within internal gear 58 and urged upwardly by a pair of compression springs 82 to conduct electricity through engagement with contact rings 55. As an added measure in assuring continuous integrity of sliding contact between the rings and pressure contacts, the contacts themselves are located diametrically opposite the juncture of lamp stem 64 to the peripheral edge of the internal gear. With this construction the tendency for the internal gear to tilt under the imbalance of weight provided by its support of lamp 63 is itself utilized in urging the contacts into sliding engagement with the rings. A center tap line 84 is also connected to the secondary windings of transformer 71 in order that switch 76 may be utilized in both turning on and off lamp 63 as well as providing a reduction in voltage drawn across the transformer for dimming the lamp.

We thus see that a horological instrument is provided which uniquely combines the attributes of sundials with those of timepieces and chronometers in meeting the above-recited objects of the invention. The instrument is durable, attractive in appearance, and even capable of providing local luminescence much as does a desk or wall lamp. The instrument may be constructed to have the dial move with respect to the instrument base and lamp or the lamp move with respect to the base and dial. If desired, the base, dial and lamp may be fixed and a mirror arranged to move a beam of light cast by the lamp over the dial. Another variation is the use of a fixed bulb remotely located and employing a fibre optic rod to transmit the shadow to the dial. Many other modifications, additions or deletions may, of course, be made to the two specifically illustrated embodiments without departure from the spirit and the scope of the inventions as set forth in the following claims.

What is claimed is:

1. A horological instrument comprising a base, an electrically energizable light source rigidly mounted to said base, a dial, gnomon means for casting a shadow on said dial, and means for imparting relative movement between said electrically energizable light source and said dial which includes an electric motor mounted to said base with a motor output shaft coupled with said dial whereby the shadow is moved with respect to the dial for indicating time.

2. A horological instrument in accordance with claim 1 wherein said dial is circular and has a surface providing a movable race, wherein said base has a surface providing a stationary race, and wherein said instrument further comprises a set of bearings rotatably disposed between said movable race and said stationary race.

3. A horological instrument comprising a base, a dial rigidly mounted to said base, an electrically energizable light source, gnomon means for casting a shadow on said dial, means for imparting relative movement between said electrically energizable light source and said dial which includes an electric motor mounted to said base whereby the shadow is moved with respect to the dial for indicating time, and wherein said electrically energizable light source is mounted to an internally toothed ring gear in mesh with a pinion secured to the output shaft of said electric motor whereby movement is imparted to the light source with respect to the dial.

4. A horological instrument comprising a dial, a gnomon mounted above said dial, means for directing a beam of light along a beam path onto said gnomon and dial, and means for moving said beam path about said gnomon to cast a shadow on the dial indicative of time which includes means for orbiting an electrically energizable light source about said gnomon.

* * * * *